United States Patent [19]

Rickert, Jr.

[11] Patent Number: 4,536,420

[45] Date of Patent: Aug. 20, 1985

[54] PROCESS AND COMPOSITION FOR PRODUCING PERMANENTLY WATER WETTABLE SURFACES

[75] Inventor: Milton E. Rickert, Jr., Louisville, Ky.

[73] Assignee: General Electric Company, Louisville, Ky.

[21] Appl. No.: 558,306

[22] Filed: Dec. 5, 1983

[51] Int. Cl.[3] ..... B05D 5/00; B05D 3/02

[52] U.S. Cl. ..... 427/257; 427/385.5; 427/388.2; 427/388.3; 427/388.4

[58] Field of Search ..... 427/257, 388.2, 388.3, 427/388.4; 428/461, 141, 152, 155

[56] References Cited

U.S. PATENT DOCUMENTS

| | | | |
|---|---|---|---|
| 2,467,341 | 4/1949 | Seymour | 524/560 |
| 2,467,342 | 4/1949 | Seymour | 524/543 |
| 2,597,872 | 5/1952 | Iler | 106/213 |
| 2,661,309 | 12/1953 | Azorlosa | 428/454 |
| 2,859,198 | 11/1958 | Sears et al. | 523/212 |
| 2,866,720 | 12/1958 | Martin et al. | 427/257 X |
| 2,882,254 | 4/1959 | Kloepfer et al. | 524/493 |
| 3,069,375 | 12/1962 | Bullitt, Jr. et al. | 524/510 |
| 3,154,427 | 10/1964 | Forrest et al. | 427/257 |
| 3,355,312 | 11/1967 | Coney | 427/257 X |
| 3,694,398 | 9/1972 | Burke, Jr. | 523/351 |
| 3,769,063 | 10/1973 | Kizawa | 427/257 |
| 3,847,856 | 11/1974 | Mueller et al. | 524/555 |
| 4,059,553 | 11/1977 | Tohyama et al. | 524/5 |
| 4,150,015 | 4/1979 | Edwards et al. | 524/555 |
| 4,163,702 | 8/1979 | Rickert, Jr. | 204/181 T |
| 4,181,773 | 1/1980 | Rickert, Jr. | 428/329 |
| 4,281,991 | 4/1981 | Michl et al. | 433/202 |
| 4,316,744 | 2/1982 | Bergna | 523/139 |

*Primary Examiner*—Thurman K. Page

*Attorney, Agent, or Firm*—Frederick P. Weidner; Radford M. Reams

[57] ABSTRACT

A process and composition which produces a permanently water wettable, abrasion-resistant film on a surface is disclosed. The composition comprises a mixture of an aqueous colloidal dispersion of carboxylic acid functional polymer; an aqueous colloidal dispersion of surface hydroxylated silica, the amount of hydroxylated silica to carboxylic acid functional polymer being sufficient to cause the formation of canals in the cured film; an amine to render the carboxylic acid functional polymer water soluble; a curing agent for the carboxylic acid functional polymer; an optionally, a wetting agent. In the process, the composition is applied to a surface to form a film, and the film is dried and/or heated at a temperature sufficient to harden or cure the film. A preferred carboxylic acid functional polymer is acrylic resin .

36 Claims, No Drawings

PROCESS AND COMPOSITION FOR PRODUCING PERMANENTLY WATER WETTABLE SURFACES

BACKGROUND OF THE INVENTION

This invention relates to a process and composition for producing permanently water wettable, abrasion-resistant films on surfaces, and more particularly, to a process and carboxylic acid functional polymer composition for producing a permanently water wettable abrasion-resistant film on surfaces.

It is sometimes desirable that a surface of an article of manufacture exposed to water be water wettable. The term "water wettable" as used herein means the ability of the surface to retain a substantially unbroken film of water thereon. This property is desirable because a water wettable surface of an article of manufacture exposed to water condensation has a lesser tendency to drip droplets of water therefrom than a surface which is not water wettable. Instead of dripping in a random fashion from the surface, the water migrates downwardly along the surface in a predictable path, and if droplets form, they can be collected at a predetermined desired point.

Water wettable surfaces are utilized, for example, on refrigeration evaporators, various other evaporators, heat exchangers, surfaces which are maintained below ambient temperature in a humid atmosphere and which are susceptible to condensation and dripping, and the like. These surfaces are generally made from various metals, for example, aluminum, copper, iron and the like, and plastics, for example, polyethylene, polyvinylchloride and the like. Various examples of articles of manufacture in which water wettability is a desirable property, are disclosed in U.S. Pat. No. 4,163,702 and U.S. Pat. No. 4,181,773.

Various compositions and methods have been utilized to render metal surfaces temporarily water wettable, however, the deficiencies of such compositions and processes are pointed out in U.S. Pat. No. 4,163,702 and U.S. Pat. No. 4,181,773. It is always desirable to improve such surfaces and the coatings which are applied thereto.

As described above, it is generally desirable to produce water wettable surfaces where drainage of the moisture and water formed thereon is facilitated to prevent undesirable dripping conditions. In many instances, this is accomplished by providing the articles which have water-wettable coatings, with drainage slopes which are often aesthetically undesirable and/or have slopes which are too great to be utilized for their intended purpose. In certain areas and for certain purposes, odor problems appear to originate from surface conditions on many of the prior art surfaces, and it is desirable to provide surfaces where odor problems have been substantially reduced or eliminated but which maintain the characteristic of water wettability.

The processes and compositions of U.S. Pat. No. 4,163,702 and U.S. Pat. No. 4,181,773 overcome many of the foregoing disadvantages, however, it is desirable to improve coating techniques, such as, reducing the number of steps required to apply coatings to surfaces, reducing the cost of equipment and process parameters used in applying coatings to surfaces and providing compositions which can be applied as coatings to plastics as well as metals. In U.S. Pat. No. 2,467,341, there is disclosed a coating composition containing an acrylic resin as the primary binder together with up to about 80% to 90% silica to produce tough, continuous coatings. However, the compositions of U.S. Pat. No. 2,467,341 do not result in improvements in the process and compositions for producing permanently water wettable, abrasion-resistant films on surfaces because of the continuous nature of the coatings. In U.S. Pat. No. 2,467,342, vinyl resins in alcohol rather than water soluble carboxylic acid functional polymers are used for coating surfaces.

SUMMARY OF THE INVENTION

It is the primary object of the present invention to provide a process and compositions for improving permanently water wettable abrasion-resistant films on surfaces.

Another object of the present invention is to provide a process and compositions for facilitating the drainage of water from permanently water wettable, abrasion-resistant films on surfaces.

Still another object of the present invention is to provide a process and compositions for producing permanently water wettable, abrasion-resistant films on surfaces of various heat exchange devices where odor problems are substantially reduced or eliminated.

It is a further object of the present invention to provide a process and compositions for producing permanently water wettable, abrasion-resistant films on surfaces of plastics as well as on surfaces of metals.

Another object of the present invention is to provide permanently water wettable, abrasion-resistant surfaces having an acceptable aesthetic appearance.

These and other objects are accomplished by a coating composition comprising a clear water borne carboxylic acid functional polymer, such as an acrylic resin colloidal dispersion, blended with an aqueous colloidal dispersion of surface hydroxylated silica which produces a film when applied to a surface, and which, when hardened or cured, provides discrete canals in the surface which tend to break up water droplets which form on the surface. The canals in the surface have a "mud cracked" pattern, and the process and compositions of the present invention provide a unique "cracking" pattern in the permanently water wettable film in much the same physical manner as sanding or other abrasion techniques by providing discrete canals which break up the water droplets.

The film or coating applied by the process of the present invention has excellent adhesion and produces a very pleasing appearance which is durable and has the ability to sheet water. In one embodiment of the present invention, there is provided a process for producing a permanently water wettable, abrasion-resistant film on a surface, comprising, (a) coating the surface with a film of a mixture of an aqueous colloidal dispersion of carboxylic acid functional polymer and an aqueous colloidal dispersion of surface hydroxylated silica, the silica solids being present in an amount sufficient to cause the formation of canals in the hardened or cured film when the mixture is applied to the surface at a suitable thickness; and (b) drying the film to provide a cured water insoluble polymer. In various embodiments, the film may be hardened by drying the film and/or heating the film. This step of the process is not critical and any drying, heating or equivalent process step or combinations thereof which brings the polymer mixture to a water insoluble state, defined herein as "hardening", may be used. In most instances, a curing agent for the carboxylic acid functional polymer is added to the mixture to promote the curing or cross-linking of the carboxylic acid functional polymer. The pattern size, depth and the water wettable property of the film are dependent on the ratio of silica solids to carboxylic acid functional polymer solids in the cured film and on the thickness of the film deposited on a surface. Thus, in accordance with the present invention, in order to achieve the improved hardened, cured film on a surface, the silica must be a hydroxylated silica; the silica solids must be present in an amount sufficient to cause the formation of discrete canals or cracks in the film, thereby resulting in a non-continuous surface; and the polymer mixture must be applied to the surface at a suitable thickness to produce the discrete canals or cracks in the surface.

The process of the present invention for producing an improved, permanently water wettable, abrasion resistant film on a surface, also comprises (a) applying a mixture of an aqueous colloidal dispersion of a carboxylic acid functional polymer, such as an acrylic resin, blended with an aqueous colloidal dispersion of surface hydroxylated silica, the amount of hydroxylated silica to polymer being sufficient to cause the formation of canals in the hardened or cured film when the mixture is applied to the surface at a suitable thickness; an amine to render the polymer water soluble; a curing agent for the polymer; and optionally, a wetting agent, to a surface; (b) drying the mixture on the surface; and/or (c) heating the mixture on the surface at a temperature sufficient to cure the polymer.

The composition which forms a permanently water wettable, abrasion resistant film having canals therein when coated upon a surface, comprises, a mixture of an aqueous colloidal dispersion of a carboxylic acid functional polymer, such as an acrylic resin, and an aqueous colloidal dispersion of surface hydroxylated silica, the silica solids being present in an amount sufficient to cause the formation of canals in the hardened, cured film when the mixture is applied to the surface at a suitable thickness. The present invention is also generally directed to a composition which forms a permanently water wettable, abrasion-resistant film on a surface and having canals therein upon hardening or curing, comprising, an aqueous colloidal dispersion of a carboxylic acid functional polymer, such as an acrylic resin; an aqueous colloidal dispersion of surface hydroxylated silica, the amount of hydroxylated silica to polymer being an amount sufficient to cause the formation of canals in the cured film when the mixture is applied to the surface at a suitable thickness; an amine to render the polymer water soluble; a curing agent for the polymer; and optionally, a wetting agent.

In an article of manufacture aspect, this invention relates to various substrates formed of various materials including metals and plastics, which present a surface rendered permanently water wettable by the film of the mixture of an aqueous colloidal dispersion of a carboxylic acid functional polymer, such as an acrylic resin, and an aqueous colloidal dispersion of surface hydroxylated silica, the silica solids being present in an amount sufficient to cause the formation of canals in the cured film when the mixture is applied to the surface at a suitable thickness. The articles of manufacture of the present invention can be any shape or of any substrate material which is receptive to the film, that is, to which the film will adhere with or without an adhesion promoter or any other suitable primer layer.

These and various other objects, features and advantages of the invention can be best understood from the following detailed description.

DETAILED DESCRIPTION OF THE INVENTION

The articles of manufacture, the surface of which can be rendered permanently water wettable according to the process of the present invention and with the compositions of the present invention, are those formed from materials which normally are not water wettable or which lose their water wettability after manufacture, upon exposure to air and/or water and thus include those formed from a metal, for example, aluminum, copper, brass, bronze, nickel, iron, stainless steel and noble metals, such as, gold, silver and platinum, and the like, and those formed from or coated with a water insoluble hydrophobic polymer, including the thermal plastics, for example, polystyrene, styrene-acrylonitrile resins, polyvinylchloride, polyvinylacetate, polyethylene, polypropylene, polybutenes, acetals, acrylics, thermoplastic polyesters and nylons, and the thermoset polymers, for example, alkyd, epoxy, phenolic, phenol-aralkyl, urea and melamine resins and thermoset unsaturated polyesters and polyurethanes, and the like. If the article of manufacture is formed of or coated with a polymer, the polymer must be one which can be coated with the mixture of the present invention, namely, an aqueous colloidal dispersion of a carboxylic acid functional polymer, such as an acrylic resin, and an aqueous colloidal dispersion of surface hydroxylated silica, the silica solids being present in an amount sufficient to cause the formation of canals in the cured film when the mixture is applied to the surface at a suitable thickness, alone or in conjunction with other ingredients, adjuvants and additives as set forth herein.

Preferred substrates, the surface of which can be rendered permanently water wettable according to the process and compositions of the present invention, are those formed from a base metal, especially those formed from aluminum or an aluminum alloy, for example, an aluminum having a high silicon content, or a composite of aluminum and steel. The article of manufacture can be in any solid shape or form, including rigid and flexible sheets, films, foils and extruded, cast, stamped and machined three-dimensional articles, including water pipes and the heat exchanger surfaces of air conditioners and evaporators and the frames of refrigerator doors, drain troughs, fresh food liner tops and other refrigerated areas which are susceptible to sweating. Preferred surfaces are those forming the heat exchanger surface of evaporators, especially aluminum air conditioner and refrigerator evaporators, and other fabricated metal articles of manufacture.

The polymer constituent of the film-forming mixture of the present invention is a carboxylic acid functional polymer or mixture thereof. The polymer is one which is curable to water-insolubility, forms a non-continuous film having discrete canals or channels therein on the substrate and can be mixed or converted into an aqueous colloidal dispersion. A wide variety of carboxylic acid functional polymers can be used in the process and compositions of the present invention including thermoplastic polymers or copolymers of acrylic acid, methacrylic acid, esters of these acids, acrylonitrile and the like. Generally, the carboxylic acid functional polymers of the present invention include homopolymers of acrylic and methacrylic acid having polymer units of the formula $$\left[\begin{array}{c}COOH\\ |\\ CR-CH_2\end{array}\right]_n$$

where R is H or $CH_3$, and n is an integer, for example, about 900 or higher, and copolymers of the foregoing with other monomers which form soluble amine or ammonium salts, for example, vinyl alkyl ether-maleic acid copolymers. Acidic polymers in which the acidic group is a sulfonic acid group, e.g., polystyrene sulfonic acids and polyethylene-sulfonic acids, a sulfato group, e.g., partially sulfated polyvinyl alcohol, or a phosphonic acid group, e.g., polyvinyl phosphonic acid group, are also operable, as are incompletely hydrolyzed alkyl acrylate and alkyl methacrylate polymers, that is, polymers having polymer units of the formula $$\left[\begin{array}{c}COOR'\\ |\\ CR-CH_2\end{array}\right]_n$$

where R and n are as defined above and a portion of the R' groups are alkyl, for example, methyl, ethyl and the like, and a remainder portion, sufficient to render ammonium and/or amine salts of the polymer water soluble, are H. The preferred polymers of the present invention are those which are the polymers of acrylic acid, this is, acrylic resins. For a discussion of such polymers, see Encyclopedia of Polymer Science and Technology, Volume 10, pages 781 et seq. (John Wiley and Sons, Inc., 1969); Kirk-Othmer, Encyclopedia of Chemical Technology, Volume II, pages 874 et seq.; Davidson and Sittig, Water Soluble Resins, Second Edition, Chapter 8 (Reinhold Publishers, 1968) and DH Solomon, The Chemistry of Organic Film Formers, Chapter 10 (John Wiley and Sons, Inc., 1967).

The polymers used in the process and compositions of the present invention are those which form water soluble salts with bases. The term "water soluble" as used herein, embraces colloidal dispersions in water, and as used herein, aqueous colloidal dispersion of carboxylic acid functional polymer embraces those polymers which are either water soluble or colloidally dispersible in water. Many of the high molecular weight polymers (acrylic resins) which are operable in the process and compositions of the present inventions, form colloidal dispersions in water rather than true solutions. However, as used herein, aqueous colloidal dispersion of carboxylic acid functional polymers includes those which form true solutions when the polymer is also soluble in water.

Although in many instances, no additives or adjuvants are required to render the carboxylic acid functional polymer water soluble or to assist in the formation of an aqueous colloidal dispersion of the polymer, it is frequently desirable to include an agent in the composition to render the polymer water soluble or to assist in the formation of the aqueous colloidal dispersion. In addition to ammonia, a wide variety of amines can be employed to render the polymer water soluble or to assist in the formation of the aqueous colloidal dispersion of the polymer. Thus, in certain preferred embodiments, the mixture of aqueous colloidal dispersion of carboxylic acid functional polymer and aqueous colloidal dispersion of surface hydroxylated silica includes an amine or amines to render the polymer water soluble or to promote the colloidal dispersion of the polymer, and as used herein, amine is also meant to embrace ammonia.

In those cases where the acrylic resin is water soluble, the amine to render the acrylic resin water soluble, is optional. However, in certain instances, up to about 10% by weight (based on the total weight of the composition) of the amine may be used to render the polymer water soluble or to render the polymer in the form of an aqueous colloidal dispersion. In certain preferred embodiments, the amine used to render the polymer water soluble, which term as used herein also includes an amine to render the polymer in the form of an aqueous colloidal dispersion, is about 0.5% by weight to about 10% by weight based on the total weight of the composition.

The preferred amines are those conventionally employed to form water soluble amine salts of polymers, namely, low molecular weight aliphatic amines, preferably tertiary alkylamines, alkanolamines and cycloaliphatic amines, for example, dialkylaminoalkanols. When the carboxylic acid functional polymer is deposited on the substrate in conjunction with the other constituents of the compositions of the present invention, as an amine salt, the amine must be sufficiently volatile to be removed when the coated substrate is dried and/or heated. Examples of such amines are dimethylaminoethanol, also known as dimethylethanolamine, ethanolamine and triethylamine.

The aqueous colloidal dispersion of surface hydroxylated silica is critical in the process and compositions of the present invention. In fact, it is critical that the silica solids in the aqueous colloidal dispersion of surface hydroxylated silica be present in an amount sufficient to cause the formation of canals in the cured film. It is also critical that the silica be a surface hydroxylated silica. In order to accomplish the formation of the discrete canals or cracks in the non-continuous, cured or hardened film, the amount of surface hydroxylated silica to carboxylic acid functional polymer, for example, acrylic resin must be in excess of 60% by weight silica solids to polymer solids, and preferably, the amount of surface hydroxylated silica to polymer is about 160% by weight to about 500% or higher by weight silica solids to acrylic resin solids. The upper limit in this ratio is limited only by the decrease in abrasion resistance. The upper limit can be greater than 500% by weight, but only up to that amount where the abrasion resistance of the film is not compromised by providing an excessive amount of silica solids to polymer solids.

Aqueous colloidal dispersions of surface hydroxylated silica are discussed in U.S. Pat. No. 3,069,375 and are referred to therein as silica aquasols which are aqueous sols of alkali-stabilized colloidal silica wherein the approximate particle size of the colloidal silica is from about 5 millimicrons to about 150 millimicrons, although the size of the silica solids is not a critical limiting factor of the process and compositions of the present invention.

A proportion of stabilizing alkali for the colloidal silica corresponding to a weight ratio of from about 75 parts to about 700 parts of $SiO_2$ per part of alkali expressed as $Na_2O$ is operative. Although the stabilizing alkali is expressed as $Na_2O$, and silica aquasols stabilized with $Na_2O$ are more readily available, silica aquasols containing a corresponding proportion of $K_2O$, $Li_2O$, $NH_3$ and lower alkyl ammonia, as the stabilizing alkali, are equally effective.

The silica aquasols, that is, the aqueous colloidal dispersions of surface hydroxylated silica, having the described characteristics are commercially available from EI DuPont de Nemours and Co., Inc., as "LUDOX" colloidal silica. The silica aquasols are prepared according to the teachings of U.S. Pat. Nos. 2,574,902 and 2,577,485. Physical properties and approximate chemical compositions of representative commercially available grades of "LUDOX" colloidal silica are shown in the following table:

| | "Ludox" LS | "Ludox" SM | "Ludox" HS | 100 millimicron colloidal solids |
|---|---|---|---|---|
| Percent Colloidal Silica | 30.0 | 15.0 | 30.0 | 24.9 |
| $SiO_2/Na_2O$ Wt Ratio | 285 | 155 | 95 | 693 |
| Viscosity at 25° C., Cps | 13 | 4.3 | 3.6 | — |
| pH at 25° C. | 8.4 | 8.5 | 9.8 | — |
| Surface Area, $m^2/g.$ $SiO_2$ | 210 | 400 | 210 | 3 |
| Approximate Particle Diameter (expressed as millimicrons) | 15 | 7 | 15 | 100 |

The surface area in the foregoing table expressed in square meters per gram of silica, is determined by the nitrogen absorption method described by P. H. Emmett's "Symposium on New Methods for Particle Size Determination", page 95, published A.S.T.M. on Mar. 4, 1941. Alkali present in the silica aquasols in stabilizing proportions for the colloidal silica ordinarily provides a pH from about 8 to about 10 for the above-described concentrated aquasols. Other aqueous colloidal dispersions of surface hydroxylated silica well-known in the art may also be used in the process and compositions of the present invention, and any colloidal surface hydroxylated silica is operable herein as long as the hydroxylated silica is dispersible in an aqueous medium.

The aqueous colloidal dispersion of carboxylic acid functional polymer, such as acrylic resin, and the aqueous colloidal dispersion of surface hydroxylated silica may be mixed by any appropriate method, for example, by using blenders, conventional stirrers, milling machines and the like so that a blend of the polymer and the silica can be achieved.

The mixture of aqueous colloidal dispersion of carboxylic acid functional polymer and an aqueous colloidal dispersion of surface hydroxylated silica, and more specifically, the polymer, must be one which is capable of forming a non-continuous cracked or channeled film on the substrate being coated. The preferred carboxylic acid functional polymer will form such films on many substrates. However, with certain polymer substrates and/or hydrophobic substrates, some adjustment of the vehicle or carrier from which the acrylic resin is deposited, for example, by varying the concentration of the carboxylic acid functional polymer in proportion to the colloidal silica or adding a wetting agent and/or an organic solvent thereto, may be required. Such techniques are standard and well-known in the coating art.

In those instances where a wetting agent is added to the compositions of the present invention, any wetting agent which will promote the spreading out or formation of a film on the particular surface, may be utilized. Thus, the wetting agent is optional and is merely added in those instances where film formation with the mixture of aqueous colloidal dispersion of polymer and aqueous colloidal dispersion of surface hydroxylated silica is difficult. As indicated above, any conventional wetting agent may be utilized in the process and compositions of the present invention, however, acetylenic alcohols are well suited for this purpose. Although it is not critical, and is not meant to be limiting, in preferred embodiments, the wetting agent may comprise up to about 12% by weight based on the total weight of the composition. One class of wetting agents is identified by the trademark "SURFY-NOL" for a group of organic surface-active agents which are acetylenic alcohols or glycols or their ethoxylated derivatives.

The film of the mixture of an aqueous colloidal dispersion of carboxylic acid functional polymer, such as an acrylic resin, and an aqueous colloidal dispersion of surface hydroxylated silica, the silica solids being present in an amount sufficient to cause the formation of canals or discrete channels in the cured film when the mixture is applied to the surface at a suitable thickness, must be curable to water insolubility so that the cured polymer is neither water soluble nor forms water soluble salts. In certain instances, the polymer is of a sufficiently high molecular weight so that it does not require a curing agent to cure the film. In this case the film may be merely dried to harden the film and form the cured, water insoluble film. Accordingly, in the broadest aspects of the process and compositions of the present invention, it is not necessary to incorporate a curing agent in the coating composition to affect the cure of the film. Thus, in those cases where the carboxylic acid functional polymer is of a sufficiently high molecular weight that it will cure by drying and/or by the application of heat thereto without the incorporation of a curing agent, no curing agent is required in the composition. However, in most instances, it may be necessary to add a curing agent to the mixture or to the composition to affect the cure of the polymer. This is accomplished by including a curing agent in the film deposited on the selected substrate. Such curing agents conventionally are cross-linking agents for the polymer and affect cross-linking when the film is heated or is exposed to another form of energy required to initiate the cross-linking reaction.

An example of the curing agents for the carboxylic acid functional polymers of the present process and compositions, are water soluble aminoplasts and their precursors which cross-link carboxylic acid functional polymers. Aminoplasts are a conventional components in coating compositions. Many of these have the formula $—NH—CH_2—OR$ wherein R is hydrogen or alkyl of one to four carbon atoms, and the unsatisfied valence is an organic moiety. Examples are the condensation products of aldehydes, particularly formaldehyde, with several amino- or amido-group-carrying substances, such as, for example, with melamine, urea, N,N'-ethyleneurea, dicyanodiamide, and benzoguanamine. There can also be used water soluble polymers having the structure of copolymerizates into which is polymerized an amide of an alpha-ethylenically unsaturated carboxylic acid having N-methylol- and/or N-methylol-ether groups.

Aminoplasts which are modified with alcohols, preferably alkanols of one to four carbon atoms, can also be used. In place of these resinous products, it is preferable to employ precursors of aminoplasts, for example, dimethylol urea, tetramethylol benzoguanamine, trimethylol melamine or hexamethylol melamine, which can also be employed in a partially or completely etherified form, for example, as dimethoxymethyl urea, tetrakis(methoxymethyl)benzoguanamine, tetrakis(ethoxymethyl)benzoguanamine, or polyethers of hexamethylol melamine, such as hexakis(methoxymethyl)melamine or hexakis(butoxymethyl)melamine. It is also possible to use mixtures of all the above N-methylol products.

Thus, a wide variety of commercially available aminoplasts can be used in the present invention. For more details regarding the aminoplasts which can be used, see "Organic Protective Coatings," Von Fischer and Bobaleck, 1953, Reinhold, pages 210–255. One of the preferred cross-linking agents of the present invention is known by the trademark "CYMEL" for a series of synthetic resins based on melamine-formaldehyde filled with alpha-cellulose, cellulose, chopped fabric, glass fiber and the like.

Depending upon the molecular weight of the carboxylic acid functional polymer in the compositions and process of the present invention, the curing agent may be utilized in quantities up to about 15% by weight or higher based on the total weight of the composition. The amount of curing agent in those embodiments where a curing agent is required, is not critical, and may be adjusted by one skilled in the art to achieve the desired polymer coating on the substrate. In certain preferred embodiments, the curing agent comprises about 5% by weight to about 15% by weight based on the total weight of the composition.

The conditions employed in the drying and/or curing steps are determined by the selected carboxylic acid functional polymer and optionally the curing agent therefor. In the process and compositions of the present invention, the film as applied to a surface is hardened. As used herein, hardening of the film embraces any step or steps which convert the water soluble polymer or polymer mixture to a water insoluble coating or film, that is, which convert the water soluble polymer to a water insoluble polymer. In certain instances this may be carried out by drying the film in air or in various non-reacting gases at ambient or elevated temperatures. In other cases the film may be hardened, that is, converted to a water insoluble polymer, by heating the film at a temperature sufficient to cure the film or any combination of the foregoing. Although curing of the acrylic resin can be achieved with some curing agents by irradiation, it is ordinarily preferred to cure by heating the coated substrate, for example, at about 135° C. to about 250° C., and more preferably from about 150° C. to about 200° C., until the polymer is insolublized, usually for a few minutes, for example, from about 30 seconds to one or more hours, and more preferably, from about 5 to about 30 minutes. Methods for determining the optimum conditions of time and temperature are well-known in the coating art. Because of the nature of the ingredients of the mixture applied to the surface, that is, because of the ingredients in the composition of the present invention, the cured polymer is water wettable. Thus, the carboxylic acid functional polymer coating is water wettable after curing without the necessity of any subsequent hydrolysis step.

The cured carboxylic acid functional polymer, such as an acrylic resin, coating on the substrate is permanent as evidenced by its resistance to abrasion, that is, subjecting the film to 1,000 double rubs or strokes using a sponge maintained at a pressure of 0.25 pounds per square inch wetted with 5% by weight baking soda. It is water wettable, as evidenced by the retention of a substantially continuous film of water thereon while in a vertical position for at least 10 seconds after immersion in or flooding with water, that is, it has water sheeting ability before and after the abrasion test.

The film of the compositions of the present invention may be coated upon the surface of the selected substrate by any suitable manner or technique. For example, the coating may be applied by dipping, spraying, brushing, padding and the like.

After the film of the composition of the present invention is coated or applied upon the surface of the substrate, the film is preferably dried at a temperature below the curing temperature to drive off any volatile substances in the composition. For example, the film is dried below the curing temperature to drive off free ammonia or amine from the film. The drying step is ordinarily required to render the surface portion of the polymer film receptive to the formation of the discrete channels or canals in the film to provide the "mud-cracking" effect discussed above. Furthermore, the drying step renders the surface portion of the acrylic resin film receptive to water wettability because of the partial conversion of the carboxylic acid functional polymer to the free acid form by the liberation of part of the amine or ammonia during the drying step. As indicated above, the drying of the film is carried out at a temperature below the curing temperature of the polymer, and in certain instances, the film is preferably dried in air prior to heating to affect the curing step. Thus, drying may be carried out in air at ambient temperatures up to the curing temperatures of the acrylic resin. For example, if the polymer cures at a temperature of about 135° C., the drying step is carried out at a temperature sufficiently below 135° C. so that curing of the acrylic resin will not occur until the volatile materials are driven therefrom and/or until the discrete canals form therein.

The thickness of the coating applied to the surface of the substrate is critical in the practice of the process of the present invention. The coating must be of sufficient thickness to provide a non-continuous film having the discrete canals, channels or cracks therein after the film is cured. The polymer coating applied to the substrate has a thickness of about $1\times10^{-3}$ to about $40\times10^{-3}$ mm, and more preferably about $1\times10^{-3}$ to about $15\times10^{-3}$ after hardening. The thickness of the coating can be regulated by various factors including the concentration of the polymer in the mixture, the viscosity of the mixture, the molecular weight of the polymer, the number of immersions, sprayings, and dippings and the like. Thus, a plurality of coatings of the film or compositions of the present invention can be applied to the surface of the substrate, and the drying and heating steps can be affected as desired. For example, a coating of the composition can be applied to the surface of a substrate, dried and heated to affect the cure, and subsequently a second coating of the film can be applied to that surface, dried and heated to affect the cure, and the like, or alternatively, a first coating can be applied to the substrate and dried followed by applying a second coating to the surface and drying until the desired build-up of coating material has been applied to the surface, and thereafter the film can be heated to affect the cure. The thickness of the coating on the surface prior to hardening by drying, heating and the like, that is, the thickness of the wet coating can vary depending upon the parameters discussed above, for example, fluid viscosity, concentration of polymer in the mixture, molecular weight of the polymer and the like. The critical factor is to apply that amount of the wet polymer mixture to the surface which provides a hardened film having a thickness which causes the formation of canals or cracks in the hardened surface. The amount of wet polymer applied to the surface is that amount which results in a thickness of about $1\times10^{-3}$ mm, to about $40\times10^{-3}$ mm, and more preferably of about $1\times10^{-3}$ mm to about $15\times10^{-3}$ mm, in the hardened film or mixture. In order to achieve these final thicknesses, in certain preferred instances, it has been found that the wet film may have a thickness of about $4.0\times10^{-3}$ mm to about $166\times10-3$ mm to the substrate.

The mixture can be applied to the surface in the form of a gel, but it is preferably applied to the surface as in a fluid medium. Thus, depending upon the concentration of the constituents in the mixture, the viscosity varies and the method of application can be varied as desired. In certain preferred embodiments, the compositions of the present invention are diluted with water or other appropriate fluid medium as desired. In one preferred embodiment, the mixture comprises up to about 90% by weight of water based on the total weight of the composition.

In addition to the foregoing ingredients, it is also possible to use other additives and adjuvants in the compositions of the present invention. For example, the compositions of the present invention can contain pigments, fillers, dyes, compatible plasticizers, compatible resins, stabilizers, inhibitors, and other adjuvants normally used in coating compositions.

The following specific examples describe the novel process and compositions of the present invention for producing permanently water wettable, abrasion-resistant films on the surfaces of various substrates. They are intended for illustrative purposes only and should not be construed as a limitation.

EXAMPLE 1

A thermosetting acrylic resin identified commercially as Celanese Poly-Tex 973 (a registered trademark of Celanese Corporation) was mixed with an acetylenic alcohol commercially available under the trademark "Surfy-nol" 104 in a ratio of 2427 grams of the acrylic resin to 272 grams of the wetting agent. The mixture was blended with a Cowles dissolver at a periphery blade speed of 3100 feet per minute for two minutes. While agitation was continued, 899 grams of a melamine-formaldehyde cross-linking agent identified as hexakismethylmethoxymelamine available commercially as Cymel 303 and 145 grams of an agent to render the acrylic resin water soluble, namely, dimethylethanolamine, were added slowly thereto. While agitation continued at 3100 feet per minute, 6782 grams of deionized water was added over a 20 minute period.

One part by volume of the foregoing mixture was blended with one part by volume of a colloidal silica identified commercially as Ludox HS 40.

A Parker standard steel Bonderite 1000 treated panel coated with an epoxy powder coating was dipped in the foregoing blend for 2 seconds, air dried for 5 minutes and then heated at about 185° C. (365° F.) for 15 minutes to cure the polymer. (Bonderite is a chemical composition for producing a corrosion-inhibiting finish on metals used to prepare metal surfaces for the subsequent application of finish coats and is generally described as an iron phosphate conversion coating.) The resulting surface was patterned with mud-cracks, that is, discrete canals or channels, and did not lift from the substrate when using a cross-hatch tape adhesion test. The coating had a water contact angle of 50 and sheeted water for 10 seconds when placed in a vertical position after being wetted under running tap water. Abrasion with 1000 double rubs using a sponge at a pressure of 0.25 pounds per square inch wetted with 5% (by weight) baking soda did not change the appearance or water sheeting ability. The water contact angle after abrasion was 53.

EXAMPLE 2

The blend of Example 1 above without the colloidal silica therein was diluted with one part by volume of water. A Parker standard steel Bonderite 1000 treated panel coated with an epoxy powder coating was dipped in the mixture for 2 seconds, air dried for 5 minutes and then cured at about 185° C. (365° F.) for 15 minutes. The resulting surface was not mud-cracked, that is, it did not have discrete canals or channels therein and had a water contact angle of 55 and did not sheet water for 10 seconds when placed in a vertical position after being wetted under running tap water.

EXAMPLE 3

One part of the acrylic resin mixture of Example 1 was blended with 3 parts by volume of the colloidal silica identified commercially as Ludox HS 40 (Ludox is a registered trademark of E. I. duPont deNemours & Co.). A Parker standard steel Bonderite 1000 treated panel coated with an epoxy powder coating was dipped in the blend for 2 seconds, air dried 5 minutes then cured at about 185° C. (365° F.) for 15 minutes. The resulting surface was patterned with mud cracks which were much smaller than in Example 1, did not lift using a cross-hatch tape adhesion test, had a water contact angle of 26 and sheeted water for 10 seconds when placed in a vertical position after being wetted under running tap water. Abrasion with 1000 double rubs using a sponge at 0.25 pounds per square inch wetted with 5% by weight baking soda, did not change the appearance or water sheeting ability. The water contact angle after abrasion was 26.

EXAMPLE 4

The blend of Example 3 was further diluted with two parts by volume blend per one part by volume water. A Parker standard steel Bonderite 1000 treated panel coated with an epoxy powder coating was dipped for 2 seconds, air dried for 5 minutes and then heated at about 185° C. (365° F.) for 15 minutes. The resulting surface was patterned with mud cracks which were only visible under magnification, did not lift using a cross hatch tape adhesion test, had a water contact angle of 24 and sheeted water for 10 seconds when placed in a vertical position after being wetted under running tap water. Abrasion with 1000 double rubs using a sponge at a pressure of 0.25 pounds per square inch wetted with 5% by weight baking soda did not change the appearance or water sheeting ability. The water contact angle after the abrasion was 29.

EXAMPLE 5

A sealing coat to provide a hydrophobic surface on a coated substrate, was prepared by mixing 36.2 parts by weight acrylic resin, 2.7 parts by weight wetting agent, 8.85 parts by weight cross-linking resin, 1.41 parts by weight diethanolamine and 50.84 parts by weight deionized water as described above. The acrylic resin, wetting agent and cross-linking resin are those which are identified in Example 1 above. The foregoing composition was diluted by using 1 part by volume deionized water and 1 part by volume of the composition. The composition was applied to heat exchange coils made of aluminum, dried and cured as discussed in Example 1 above. A second coating composition was prepared by utilizing 16.67% by volume of the hydrophobic sealing coat discussed above, 50% by volume of the colloidal silica identified commercially as Ludox HS 40 and 33.33% by volume deionized water. This hydrophilic coating was applied to the surface of the aluminum coils having the sealing coat composition applied and cured thereto, and was subsequently dried and cured at the conditions indicated for Example 1 above. The resulting surface was patterned with mud cracks and did not lift using a cross-hatch tape adhesion test and had other properties similar to those discussed above.

It was noted that aluminum coils coated by the hydrophilic coating of Example 5 provided good coil drainage for moisture accumulating thereon during heat exchange usage. It was observed that odor problems were eliminated when the hydrophilic coating was applied to the seal coat, that is, to the hydrophobic coating on the surface of the aluminum coils. Aluminum metal has a wettable surface. However, aluminum absorbs odor bodies. The water insoluble film of the present invention prevents the absorption of the odor bodies by the aluminum while maintaining the original water wettability properties of the aluminum.

In accordance with at least some of the objects of the present invention, a surface which has an acceptable aesthetic appearance, has been provided by the process and compositions of the present invention. The process and compositions of the present invention produce a film, which when cured, has a "mud cracked" surface similar to a flooded field after drying. This unique cracking provides a water wettable surface in much the same physical manner as sanding or other abrasion techniques by providing discrete canals to break up water droplets which accumulate on the surface. The coating when applied over other coatings has excellent adhesion and produces a very pleasing appearance which is durable and has the ability to sheet water. Furthermore, it has been noted that the process and compositions of the present invention inhibit or eliminate odors in heat pumps when it is applied to the heat exchange coils used in such heat pumps.

While other modifications of the invention and variations thereof which may be employed within the scope of the invention have not been described, the invention is intended to include such modifications as may be embraced within the following claims.

What is claimed is:

1. A process for producing a permanently water wettable, abrasion-resistant film on a non-water-absorbing surface, consisting essentially of:

(a) coating the surface with a film of a mixture of an aqueous colloidal dispersion of carboxylic acid functional polymer which is curable to water insolubility, and an aqueous colloidal dispersion of surface hydroxylated silica, the silica solids being present in an amount sufficient to cause the formation of canals in the hardened film when the mixture is applied to the surface at a suitable thickness; and (b) hardening the film to provide a water insoluble polymer.

2. The process of claim 1 further comprising adding a curing agent for the carboxylic acid functional polymer to the mixture.

3. The process of claim 2 wherein the curing agent is selected from the group consisting of dimethoxymethyl urea, tetrakis(ethoxymethyl) benzoguanamine, hexakis(-methoxymethyl)melamine and hexakis(butoxymethyl)-melamine.

4. The process of claims 1 or 2 wherein an agent is added to the acrylic resin to render the carboxylic acid functional polymer water soluble.

5. The process of claim 4 wherein the agent is an amine selected from the group consisting of tertiary alkylamines, alkanolamines and cycloaliphatic amines.

6. The process of claims 1 or 2 further comprising adding a wetting agent to the mixture.

7. The process of claim 6 wherein the wetting agent is an acetylenic alcohol.

8. The process of claims 1 or 2 wherein the amount of surface hydroxylated silica to carboxylic acid functional polymer is in excess of 60% by weight silica solids to carboxylic acid functional polymer solids.

9. The process of claims 1 or 2 wherein the amount of surface hydroxylated silica to carboxylic acid functional polymer is about 160% by weight to about 500% by weight silica solids to carboxylic acid functional polymer solids.

10. The process of claims 1 or 2 wherein the film thickness of the coating after hardening is about $1\times10^{-3}$ mm to about $40\times10^{-3}$ mm.

11. The process of claims 1 or 2 wherein the film thickness of the coating after hardening is about $1\times10^{-3}$ mm to about $15\times10^{-3}$ mm.

12. The process of claims 1 or 2 comprising hardening the film by drying the film in air.

13. The process of claims 1 or 2 comprising hardening the film by heating the film at a temperature sufficient to cure the polymer.

14. The process of claims 1 or 2 comprising hardening the film by drying the film in air and subsequently heating the film at a temperature sufficient to cure the polymer.

15. The process of claims 1 or 2 wherein the film is heated at about 135° C. to about 250° C. to cure the polymer.

16. The process of claims 1 or 2 comprising applying a plurality of coatings of the film on the surface, and hardening the film after each application.

17. The process of claims 1 or 2 wherein the surface is a metal.

18. The process of claims 1 or 2 wherein the surface is a plastic.

19. The process of claims 1 or 2 wherein the surface is a metal coated with an adhesion promoter.

20. The process of claims 1 or 2 wherein the carboxylic acid functional polymer is an acrylic resin.

21. A metal article of manufacture presenting a surface which has a water insoluble coating thereon of a water soluble carboxylic acid functional polymer which has been cured to water insolubility and rendered water wettable by the process of claims 1 or 2.

22. A process for producing an improved permanently water wettable, abrasion resistant film on a non-water-absorbing surface, consisting essentially of:

(a) applying to a surface a mixture of an aqueous colloidal dispersion of carboxylic acid functional polymer; and aqueous colloidal dispersion of surface hydroxylated silica, the amount of hydroxylated silica being sufficient to cause the formation of canals in the hardened mixture when the mixture is applied to the surface at a suitable thickness; an amine to render the carboxylic acid functional polymer water soluble; a curing agent for the carboxylic acid functional polymer; and optionally, a wetting agent; and (b) hardening the mixture on the surface to provide a cured water insoluble polymer.

23. The process of claim 22 wherein the amine comprises about 0.5% by weight to about 10% by weight based on the total weight of the composition.

24. The process of claim 22 wherein the curing agent comprises about 5% by weight to about 15% by weight based on the total weight of the composition.

25. The process of claim 22 wherein the wetting agent comprises up to about 12% by weight based on the total weight of the composition.

26. The process of claim 22 wherein the mixture comprises up to about 90% by weight of water based on the total weight of the composition.

27. The process of claim 22 wherein the thickness of the coating after hardening is about $1\times10^{-3}$ mm to about $40\times10^{-3}$ mm.

28. The process of claim 22 wherein the thickness of the coating after hardening is about $1\times10^{-3}$ mm to about $15\times10^{-3}$ mm.

29. The process of claim 22 comprising hardening the mixture on the surface by drying the mixture in air.

30. The process of claim 22 comprising hardening the mixture on the surface by heating the mixture at a temperature sufficient to cure the polymer.

31. The process of claim 22 comprising hardening the mixture on the surface by drying the mixture in air and subsequently heating the mixture at a temperature sufficient to cure the polymer.

32. The process of claims 22, 30 or 32 wherein the mixture is heated at about 135° C. to about 250° C.

33. The process of claims 22, 27 or 28 wherein the amount of surface hydroxylated silica to carboxylic acid functional polymer is in excess of 60% by weight silica solids to carboxylic acid functional polymer solids.

34. The process of claims 22, 27 or 28 wherein the amount of surface hydroxylated silica to carboxylic acid functional polymer is about 160% by weight to about 500% by weight silica solids to carboxylic acid functional polymer solids.

35. The process of claim 22 wherein the carboxylic acid functional polymer is an acrylic resin.

36. A metal article of manufacture presenting a surface which has a water insoluble coating thereon of a water soluble carboxylic acid functional polymer which has been cured to water insolubility and rendered water wettable by the process of claim 22.

* * * * *